US005506592A

United States Patent [19]

MacDonald et al.

[11] Patent Number: 5,506,592

[45] Date of Patent: Apr. 9, 1996

[54] MULTI-OCTAVE, LOW PROFILE, FULL INSTANTANEOUS AZIMUTHAL FIELD OF VIEW DIRECTION FINDING ANTENNA

[75] Inventors: Alan D. MacDonald, Dallas; Landon Rowland, McKinney, both of Tex.

[73] Assignee: Texas Instruments Incorporated, Dallas, Tex.

[21] Appl. No.: 449,497

[22] Filed: May 24, 1995

Related U.S. Application Data

[63] Continuation of Ser. No. 153,940, Nov. 17, 1993, abandoned, which is a continuation of Ser. No. 891,306, May 29, 1992, abandoned.

[51] Int. Cl.[6] ..... H01Q 1/48

[52] U.S. Cl. ..... 343/846; 343/795; 343/830; 343/873

[58] Field of Search ..... 343/700 MS, 767, 343/773, 774, 808, 825, 828, 829, 830, 844, 846, 849, 893, 897, 908, 795, 841, 873, 792, 789, 792.5, 826

[56] References Cited

U.S. PATENT DOCUMENTS

| | | | |
|---|---|---|---|
| 3,815,141 | 6/1974 | Kigler | 343/873 |
| 4,162,499 | 7/1979 | Jones, Jr. et al. | 343/700 MS |
| 4,414,550 | 11/1983 | Tresselt | 343/700 MS |
| 4,814,777 | 3/1989 | Monser | 343/826 X |
| 4,879,562 | 11/1989 | Stem et al. | 343/700 MS |
| 5,164,738 | 11/1992 | Walter et al. | 343/789 |
| 5,185,611 | 2/1993 | Bitter, Jr. | 343/702 |
| 5,229,777 | 7/1993 | Doyle | 343/700 MS |

FOREIGN PATENT DOCUMENTS 0107202 5/1991 Japan .

*Primary Examiner*—Donald T. Hajec
*Assistant Examiner*—Tan Ho
*Attorney, Agent, or Firm*—René E. Grossman; Richard L. Donaldson

[57] ABSTRACT

An antenna which comprises a plurality of spaced apart antenna segments (1–8) which are electrically isolated from each other and form a conical antenna structure, an insulator (9) disposed between each of the antenna segments, a plurality of conductors (11), each coupled to a different one of the antenna segments, for sampling a predetermined parameter at the associated antenna segment and a ground plane (10) normal to the axis of the conical structure. The antenna segments are substantially pie-shaped. In a second embodiment of the invention, the antenna segments are disposed on an electrically insulating sheet, each of the antenna segments being flared at the corner regions thereof (22) remote from the apex of the conical structure. The space between each of the segments is a slot, the slot operational as a slot antenna when the segments on opposing sides of the slot are excited 180 degrees out of phase.

41 Claims, 9 Drawing Sheets

| | 1 | 2 | 3 | 4 | 5 | 6 | 7 | 8 |
|---|---|---|---|---|---|---|---|---|
| MODE 0 | 0 | 0 | 0 | 0 | 0 | 0 | 0 | 0 |
| MODE 1 | 0 | 45 | 90 | 135 | 180 | 225 | 270 | 315 |
| MODE-1 | 0 | 315 | 270 | 225 | 180 | 135 | 90 | 45 |

MULTI-OCTAVE, LOW PROFILE, FULL INSTANTANEOUS AZIMUTHAL FIELD OF VIEW DIRECTION FINDING ANTENNA

This application is a Continuation of application Ser. No. 08/153,940 filed on Nov. 17, 1993, abandoned which is a continuation of application Ser. No. 07/891,306 filed on May 29, 1992, which is now abandoned.

BACKGROUND OF THE INVENTION

1. Field of the Invention

This invention relates to direction finding antenna systems and, more specifically, to a multi-octave, instantaneous, full azimuthal field of view (FOV) direction finding (DF) antenna.

2. Brief Description of the Prior Art

Electronic information gathering systems require accurate, multi-octave DF performance including low angle of arrival (AOA) error and large FOV, optimally a full 360 degree azimuthal FOV. Most prior art DF systems are normally grouped into two operational categories, these being (1) amplitude only DF and (2) phase DF.

Amplitude only DF is limited in accuracy, and typically can only be used for quadrant information in the azimuthal plane unless a gimbal system is used. In order to achieve very accurate DF, a phase DF approach must be used.

In the prior art, two basic approaches have been used to realize the above mentioned DF techniques, these being (1) fixed circular arrays of individual antennas and (2) a mechanically gimballed antenna or array of antennas.

The first approach has been to use a circular array of individual antennas, oriented radially outward in sufficient numbers to provide the required 360 degree FOV coverage. The number of antennas placed in the array is dependant upon the beamwidth of the individual antennas in the array. This approach suffers from several disadvantages, these being size and frequency band limitations. To achieve high gain, multi-octave performance, antennas (normally termed frequency independent antennas) become electrically large. An above mentioned circular array of such antennas would in turn require a large amount of volume. Due to the large electrical size of the frequency independent antennas, the associated phase centers of the antennas are spaced electrically distant. In a circular array configuration, as the operating frequency of the array increases, the electrical separation between these phase centers becomes greater than one half wavelength, this in turn generating grating lobes in the far field radiation patterns of the circular array. These grating lobes distort the measured phase response of the array, thereby greatly increasing the AOA errors of the DF system. These AOA errors limit the upper operating frequency of the DF circular array. Accordingly, the frequency bandwidth of the prior art generally does not exceed a single octave.

Another deficiency encountered in the antenna array approach is the destructive interaction between the individual antennas. Mutual coupling between the individual antenna elements, which conceptually operate independently, degrades far field radiation pattern performance. This interaction corrupts the desired phase response of the individual antennas, consequently reducing the DF performance of the entire system.

The second technique uses a single antenna or an array of antennas placed upon a mechanical gimbal. The gimbal is rotated to provide the required FOV. This technique requires very accurate computational correlation between the physical location of the gimbal and the received signal of the antenna system. In order to achieve this accurate correlation with sufficient reliability, the complexity and cost of the gimbal/DF system must be greatly increased. An additional disadvantage of a gimballed system is that it can not provide an instantaneous 360 degree FOV. For a gimbal DF system to achieve performance approaching that of an instantaneous system, the gimbal must have extremely fast scanning speeds, further increasing the complexity, cost and unreliability of the system.

It is therefore readily apparent that the deficiencies in the prior art do not allow for the construction of multi-octave, low profile and reliable direction finding antenna systems that provide the instantaneous full 360 degree azimuthal coverage required in electronic intelligence gathering applications.

SUMMARY OF THE INVENTION

In accordance with the present invention, the deficiencies inherent in the prior art are minimized and there is provided an improved multi-octave (up to 36:1 bandwidth), instantaneous, full 360 degree azimuthal DF antenna system. There is also provided a high reliability, compact, low profile, low cost solution to the azimuthal DF problem. This is accomplished by eliminating the need for a gimbal or an array of frequency independent antennas.

A monocone antenna placed above a ground plane is an electrical equivalent to the biconical antenna. The biconical antenna operates as a non-resonant TEM antenna which allows for multi-octave frequency operation. The monocone antenna over a ground plane provides the frequency independent antenna required for the above described particular DF application. A z-axis oriented monocone antenna intrinsically has an isotropic radiation pattern about the entire phi (360 degree azimuth) plane, making it an excellent candidate for use in a full azimuthal DF system.

Briefly, a single monocone antenna is mounted onto a fixed body, such as an airframe, which operates as the ground plane required for the monocone antenna operation. The intrinsic FOV of the monocone antenna about the monocone axis removes the need for an array of individual antennas or the use of a gimbal. The monocone antenna axis is aligned with the normal to the mounting surface.

The monocone antenna is segmented into individual symmetric pieces, similar to pie-pieces or a sector of a circle, to allow for the sampling of the modal content present on the surface of the antenna. The modal content of the segmented monocone antenna is determined by the measurement of the excitation currents present on each of the antenna segments. The sampling of these currents is accomplished with the electrical connection of coaxial cables to each individual segment. These segment excitations are combined into modal components through the connection of an RF mode former circuit. The antenna segments are insulated from each other by the use of a very thin nonmetallic spacer, for example, a low loss polytetrafluoroethylene sheet no greater than two tenths of a wavelength (at the highest operational frequency) in thickness, air or the like. The segmentation of the monocone antenna is completed so as not to destroy the intrinsic operation and far field radiation pattern of a whole monocone antenna of the same geometric dimensions.

The non-interfering segmentation is accomplished by minimizing the physical separation between each antenna segment. The separation between antenna segments should be no greater than two tenths of a wavelength at the highest frequency of operation. By allowing minimal interruption of the normal current distribution of a monocone antenna, the radiation characteristics of the segmented monocone antenna will approach those of the normal monocone antenna. Replicating the normal monocone antenna performance alleviates the two major problems associated with the prior art, namely antenna array grating lobes and the need for mechanical gimballing.

A thin electromagnetic absorbing material, such as, for example, a silicon loaded material, is placed on the top of the monocone to attenuate currents that propagate along the top surface of the antenna. The same material may be placed on the side edges of the antenna to reduce reflections from the truncated edges of the antenna.

The segmented monocone antenna need not be comprised of solid conic sections. One version of the invention involves the generation of the segmented monocone antenna with a set of curved plates. These plates present the equivalent radiation surface region as the segmented monocone antenna. The plate generated segmented monocone antenna has several advantages over the solid version. The plate generated segmented monocone antenna is lighter and provides a better impedance match to the 50 ohm coaxial feed cables. The plate generated segmented monocone antenna minimizes segment impedance mismatch problems through the reduction of segment to segment capacitance and the elimination of the top path for current propagation. Yet another advantage of the invention is the ability to model the slot between the antenna segments as a transmission line when the slot opposing segments are excited or energized 180 degrees out of phase. This specific excitation or energization produces a potential difference across the slot, allowing the slot to behave as a transmission line, specifically, a slotline. Appropriate flaring of the slot (as the slot approaches the outer radius of the plate generated segmented monocone) allows for the radiation of a linearly polarized signal orthogonal to the monocone axis. However, the operational bandwidth of the flared slot antenna may not be as broad as that of the segmented monocone antenna. The combination of the linearly polarized monocone antenna segments and the orthogonally polarized flared slot antennas produce a polarization diverse antenna system.

Each of the segments is connected to a coaxial transmission line which is in turn connected to a modal processor. The modal processor combines the signals from all the segments to generate the modal phases required for AOA calculations. The required AOA accuracy determines which modes are selected. The modal phases are then compared to determine the AOA information from the signal incident to the segmented monocone antenna. Selection between radiation through the segmented monocone antenna or the flared slot array is determined by the modal processor attached to the plate generated segmented monocone antenna.

DESCRIPTION OF THE PREFERRED EMBODIMENTS

Figure 1A:
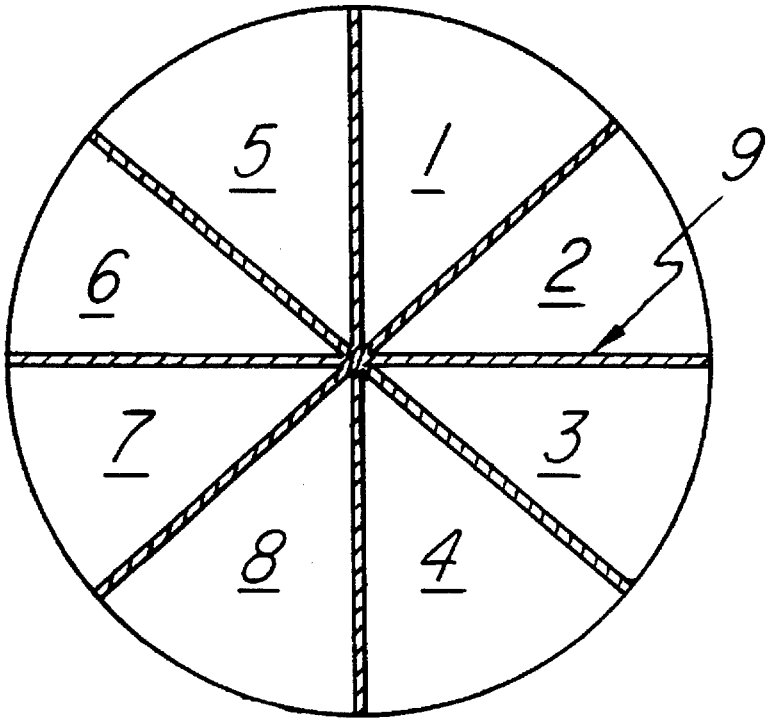
FIGS. 1A and 1B are plan and elevational views respectively of the segmented monocone antenna in accordance with the present invention.
Figure 1B:
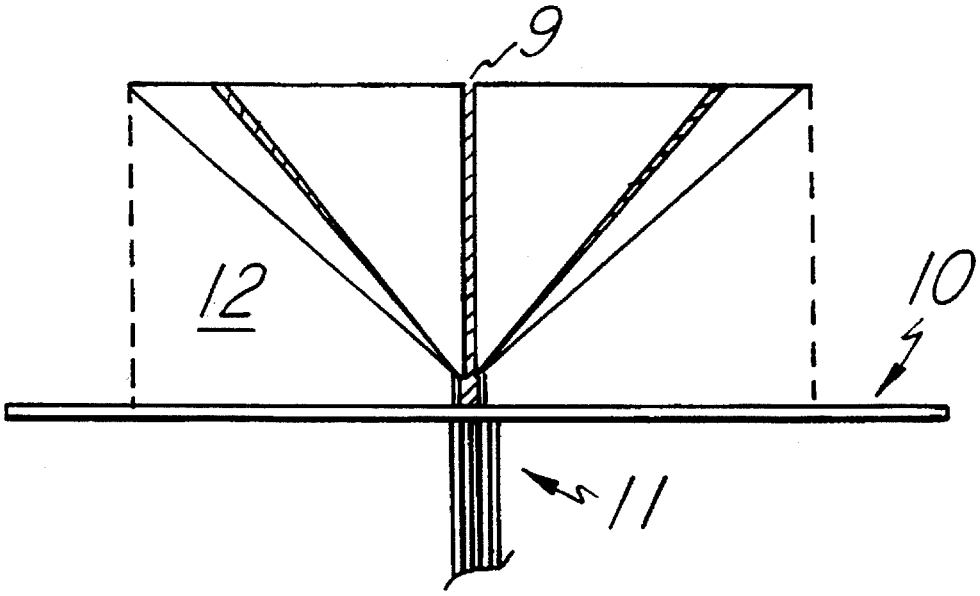

Referring to the drawings, FIG. 1A is a top view of the segmented monocone antenna in accordance with the present invention. The eight individual antenna segments 1 through 8 are separated by polytetrafluoroethylene sheets 9 which are 0.2 of a wavelength in thickness at the highest operational frequency of the antenna. The segments and insulators are fixed into place with thermal bonding adhesive films (not shown). The monocone antenna can be segmented into two or more sections, depending upon the application. FIG. 1B is a side view of the eight segment monocone antenna mounted on a truncated ground plane 10. The coaxial transmission lines 11 are connected, one to each antenna segment 1 through 8. A dielectric material 12, may be placed beneath the monocone antenna segments to provide structural stability. The dielectric constant of the material may be selected to provide the desired response. The angle which the segments 1 through 8 of the monocone antenna make with the ground plane 10 is related to the impedance of the antenna. For an infinite monocone antenna, the input impedance is given by:

$$Z_{in}=60\ \ln(\cot(\Theta_h/2))\text{ohms}$$

where $\Theta_h$ is the complement of the angle between the segments and the ground plane. For example, for a 50 ohm coaxial cable match, the angle between the segments and the ground plane would be 43°. Therefore, the cone angle is variable and dependent upon the application. It should be noted that truncation of the infinite monocone antenna to a finite monocone antenna will vary the ideal cone angle, which can be determined empirically.

Figure 2A:
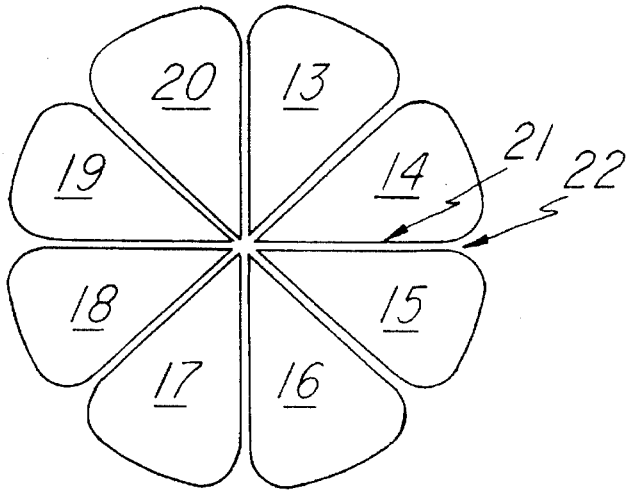
FIGS. 2A and 2B are plan and elevational views respectively of the plate generated segmented monocone antenna according to the present invention.

FIG. 2A is a top view of the plate generated segmented monocone antenna. Note that in this configuration the segments comprise individual plates 13 through 20 that are placed and curved into the conic surface of the original segmented monocone antenna structure. In this configuration, the plates 13 through 20 are two dimensionally etched onto a single low loss polytetrafluoroethylene sheet (not shown) and then wrapped to form the three dimensional cone. The plates 13 through 20 operate in the same manner as the solid segmented monocone antenna segments of FIG. 1, receiving incident radiation polarized parallel to the monocone axis. However, when any of the adjacent segments are excited 180 degrees out of phase, the slot, for example slot 21 between the segments 14, 15, becomes a transmission line, characterized as a slotline. The slot is then flared at 22 near the outer radius of the cone. This flared slot serves as an antenna polarized orthogonal to the monocone axis.

Figure 2B:
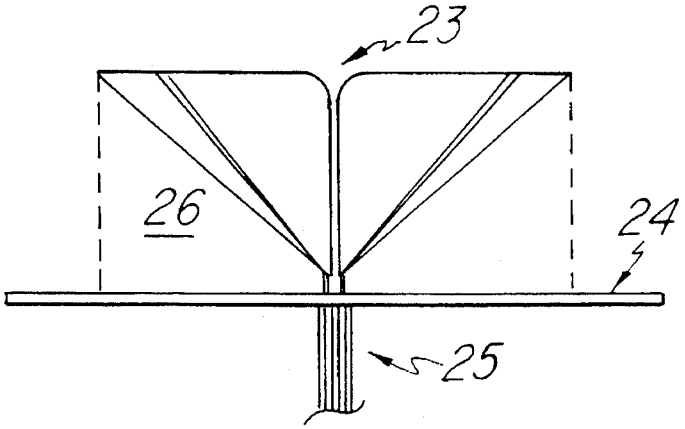

FIG. 2B is a side view of the dual polarized plate generated segmented monocone antenna, similar in appearance to the solid segmented monocone antenna with the exception of the flared slots. The antenna is shown placed over a ground plane 24 and each plate 13 through 20 is connected to a separate coaxial cable 25 as in the embodiment of FIGS. 1A and 1B. As with the solid segmented monocone, the antenna can be structurally supported with a dielectric material 26 which is dependent upon the application.

Figure 3:
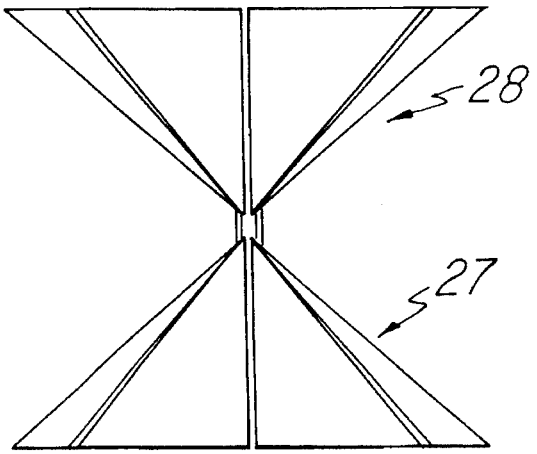
FIG. 3 is a side view of a biconical version of an antenna in accordance with the present invention.

Although both FIGS. 1 and 2 disclose the invention as a monocone antenna, it should be understood that the invention herein extends to biconical structures. This is shown specifically in FIG. 3 wherein the ground plane 10,24 of FIGS. 1 and 2 is removed and the mirror image 27 of the monocone antenna 28 is added, generating a segmented biconical antenna.

Figure 4A:
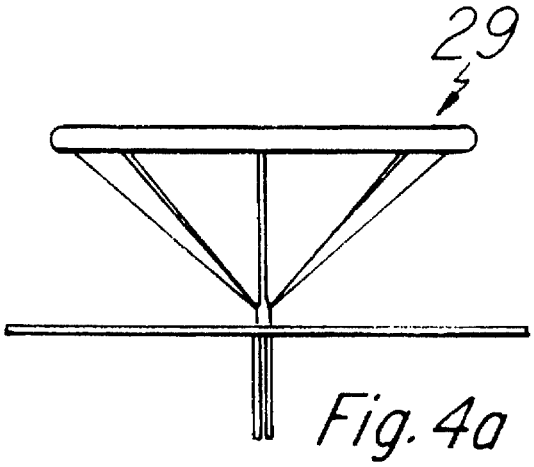
FIGS. 4A and 4B illustrate the placement of electromagnetic absorptive materials on the segmented monocone antenna and FIG. 4C illustrates the placement of electromagnetic absorptive materials on the plate generated segmented monocone antenna.
Figure 4B:
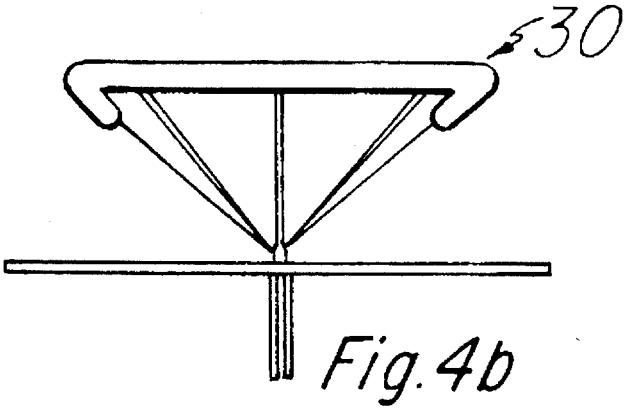
Figure 4C:
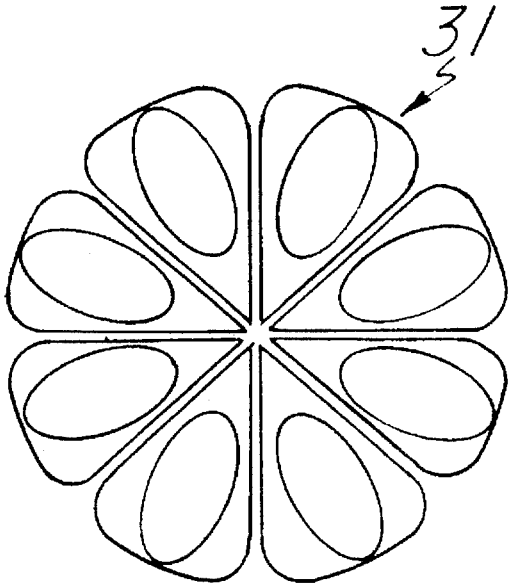

FIGS. 4A and 4B show the placement of electromagnetic absorbent material 29 on the surfaces of the solid segmented monocone antenna. The electromagnetic absorbing material 29, such as, for example, iron loaded silicon, placed upon the monocone top, limits the amount of current that propagates from segment to segment along the monocone antenna top surface. The electromagnetic absorbing material placed on the sides of the monocone antenna 30 as shown in FIG. 4B reduces reflections from the truncation of the monocone. FIG. 4C shows the placement of electromagnetic absorbent material 32 on the top surface of the plate generated segmented monocone 31. The absorptive material 32 is trimmed back in the proximity of the slot and flared slot antenna to allow for effective transmission and radiation of the horizontal polarization. The absorptive material 32 is extended to the outer radial edge of the plate to minimize diffracted components from the thin edge. The absorptive material 32 is trimmed away from the feed region to prevent attenuation of the feed currents.

Figure 5:
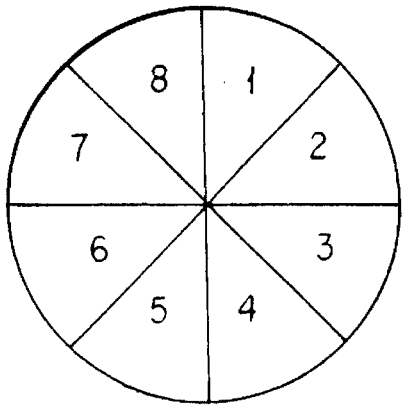
FIG. 5 is a block diagram of the modal processing network employed for the segmented monocone antenna in accordance with the present invention.
Figure 5:
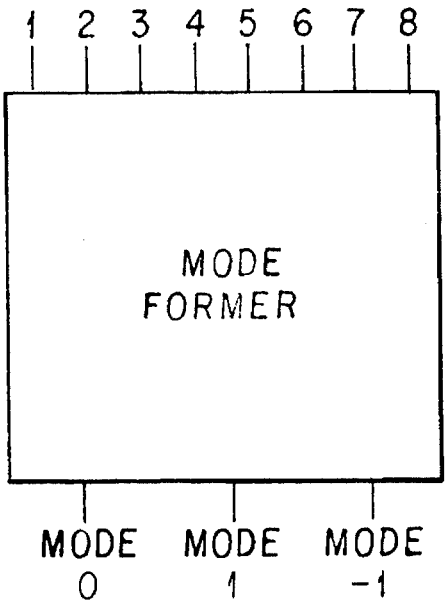

FIG. 5 shows the operation of the modal processor for the solid segmented monocone antenna. The number of modes present in the system is equal to the number of segments in the monocone antenna, given integer numbers in the range $$-(N-1)/2 \leqq M \leqq N/2 \text{ or } 1 \leqq M \leqq N$$

where:

M=Modal number (integer)

N=Total number of segments

The antenna segments are numbered 41 through 48 in a clockwise manner and are fed to the respective inputs also numbered 41 through 48 of the modal processor 49. The processor 49 combines the inputs from all eight segments, applies the modal filtering to the inputted signals and outputs the desired modal signals. Although the processor shown in FIG. 5 forms modes ±/−1 and mode 0, it will be appreciated that the processor is not limited as such and can be designed to output any desired modal phase that is supported by the antenna. The excitation phase of each segment is determined by the mode present on the antenna, which is given as:

$$\Theta_n = 2\pi m(n-1)/N$$

where:

$\Theta_n$=Modal phase of segment n n=Segment number m=Mode number

N=Total number of segments

For this specific example, the AOA is obtained by subtracting the phase of mode −1 (the same as mode 7) from the phase of mode 1 and dividing by the modal separation. It is noted that the particular modes described herein are for illustration only, In practice, any of the supported modes may be used as long as they have the desired modal separation and adequate performance. The general equation for the AOA is given by:

$$AOA = (\phi_m - \phi_n)/k$$

where:

AOA=Angle of arrival of incoming signal $\phi_m$=Phase of mode m $\phi_n$=Phase of mode n k=Modal separation (m−n)

A matrix of the Mode 0, 1 and −1 segment phase is shown in FIG. 5.

Figure 6:
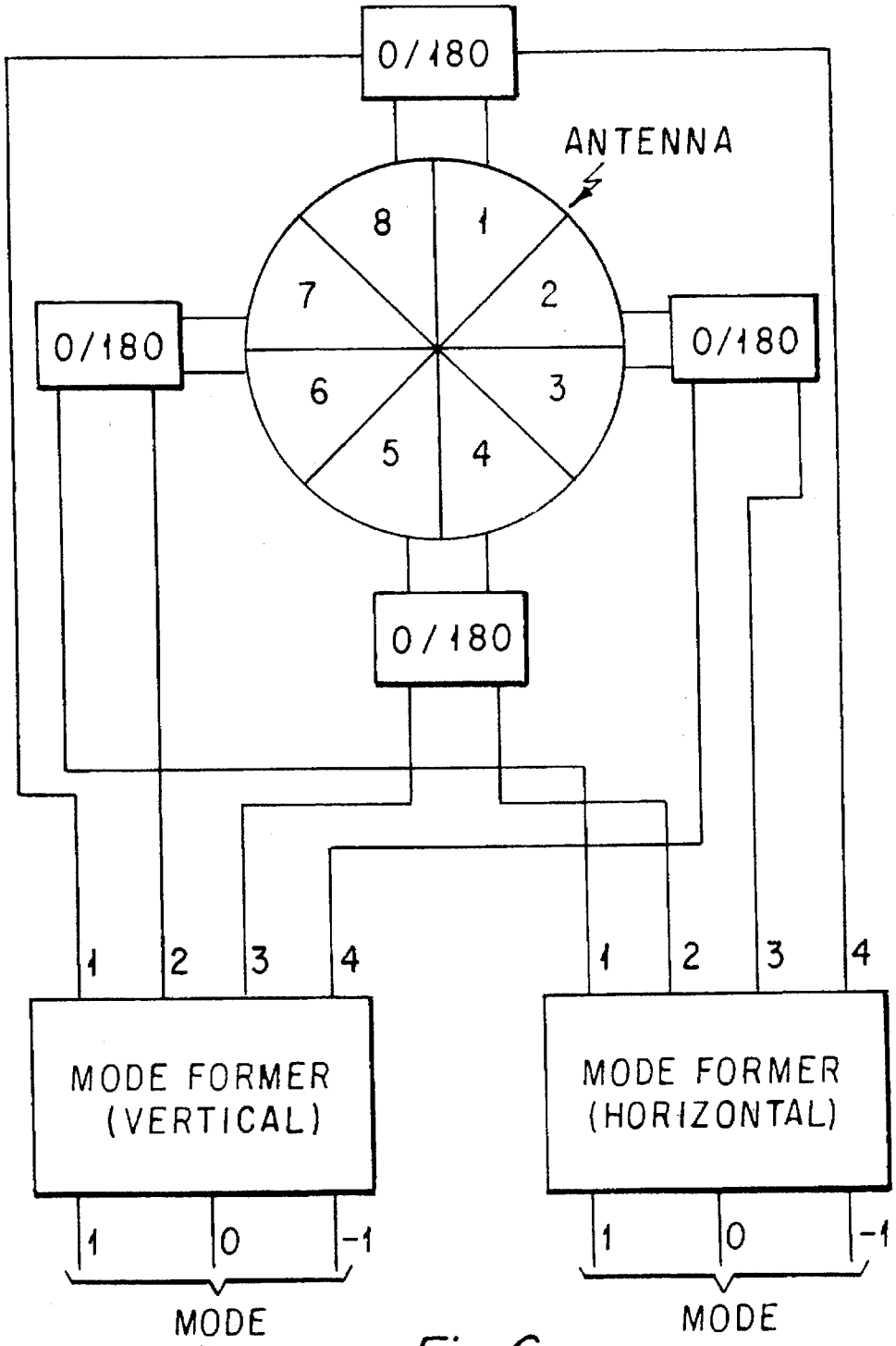
FIG. 6 is a block diagram of the modal processing network employed for the plate generated segmented monocone antenna in accordance with the present invention.

FIG. 6 shows the modal processing required for the simultaneous excitation of both polarizations in the plate generated segmented monocone antenna. Although FIG. 6 shows eight segment modal processing of the modes 0, 1 and −1, it should be understood that the number of segments or modes is not limited as such. Four magic tees 51 through 54 are placed between four antenna segment pairs. Specifically, in-phase excitation of the adjacent segments generates the equivalent gain and pattern performance of a plate of that total size. Out-of-phase excitation of the slot adjacent segments generates potential across the slot, subsequently exciting the flared slot radiator. Each output port of the magic tee corresponds to the excitation of either the vertically polarized segment (in-phase magic tee port) or the horizontally (orthogonal) polarized flared slot (out-of-phase magic tee port). Attaching an individual mode processor to vertically 55 and horizontally 56 polarized magic tee ports allows for simultaneous sampling of all incident polarizations.

Figure 7A:
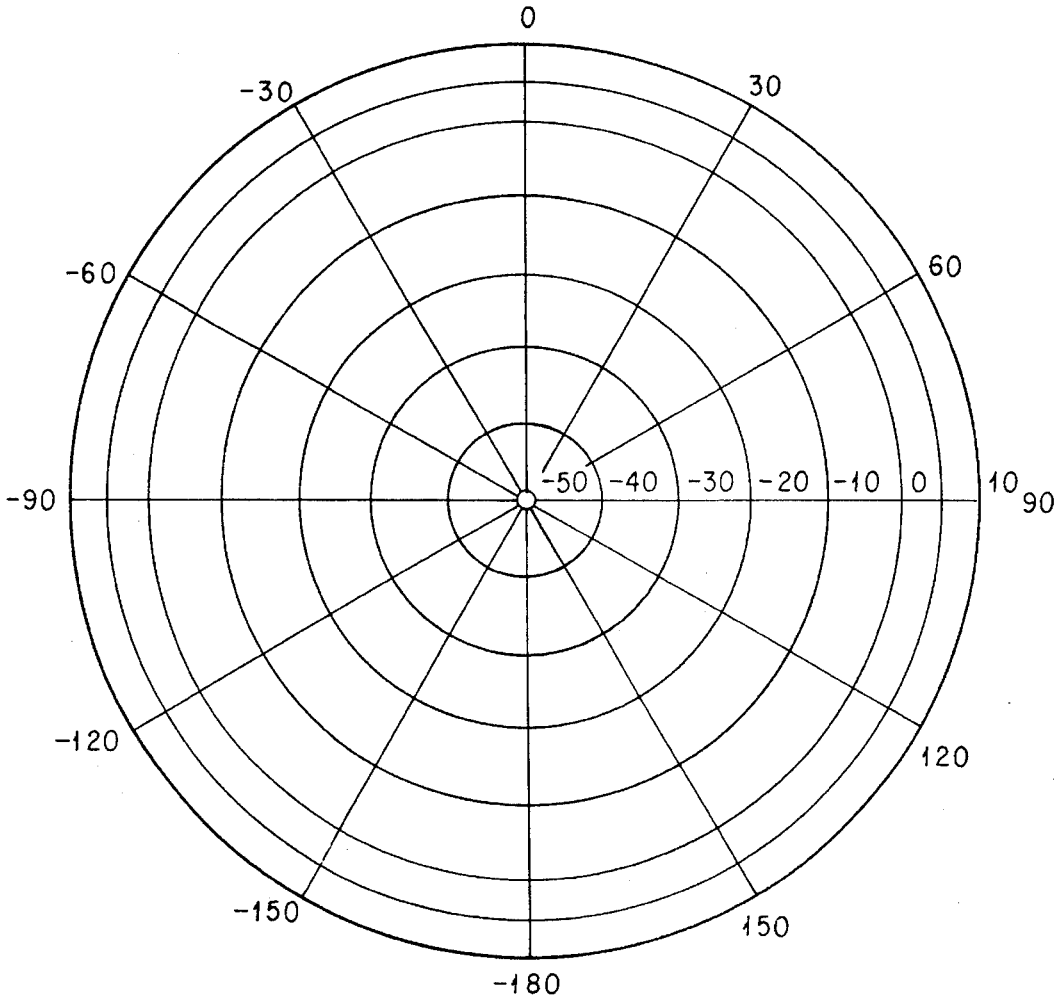
FIGS. 7A and 7B illustrate the typical azimuthal mode 0 and mode 1 far field radiation pattern performance respectively against a vertically polarized source.
Figure 7B:
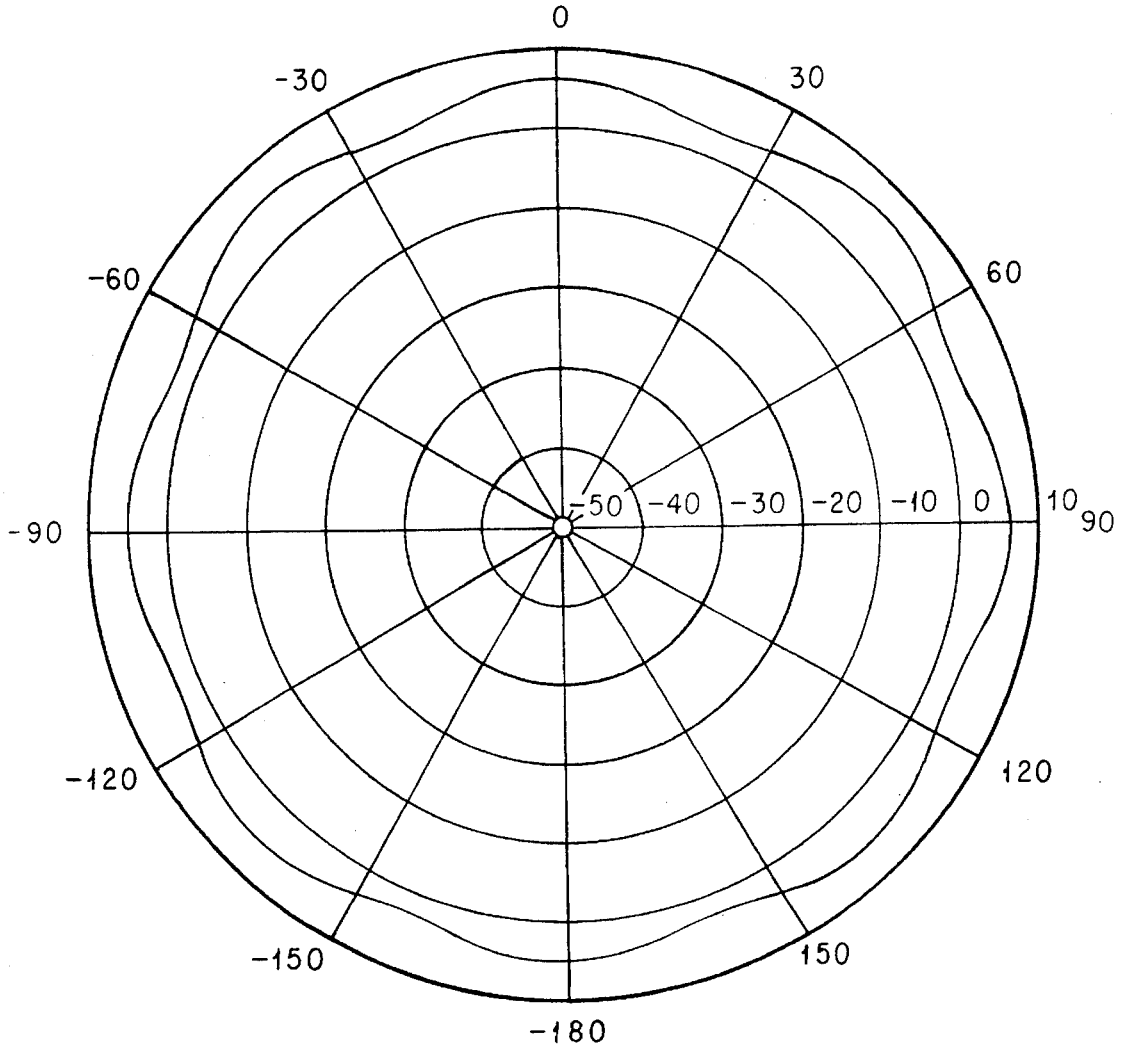

Referring now to FIGS. 7A and 7B, there is shown the typical azimuthal mode 0 and mode 1 far field radiation pattern performance against a linearly polarized source parallel to the monocone axis.

Figure 8:
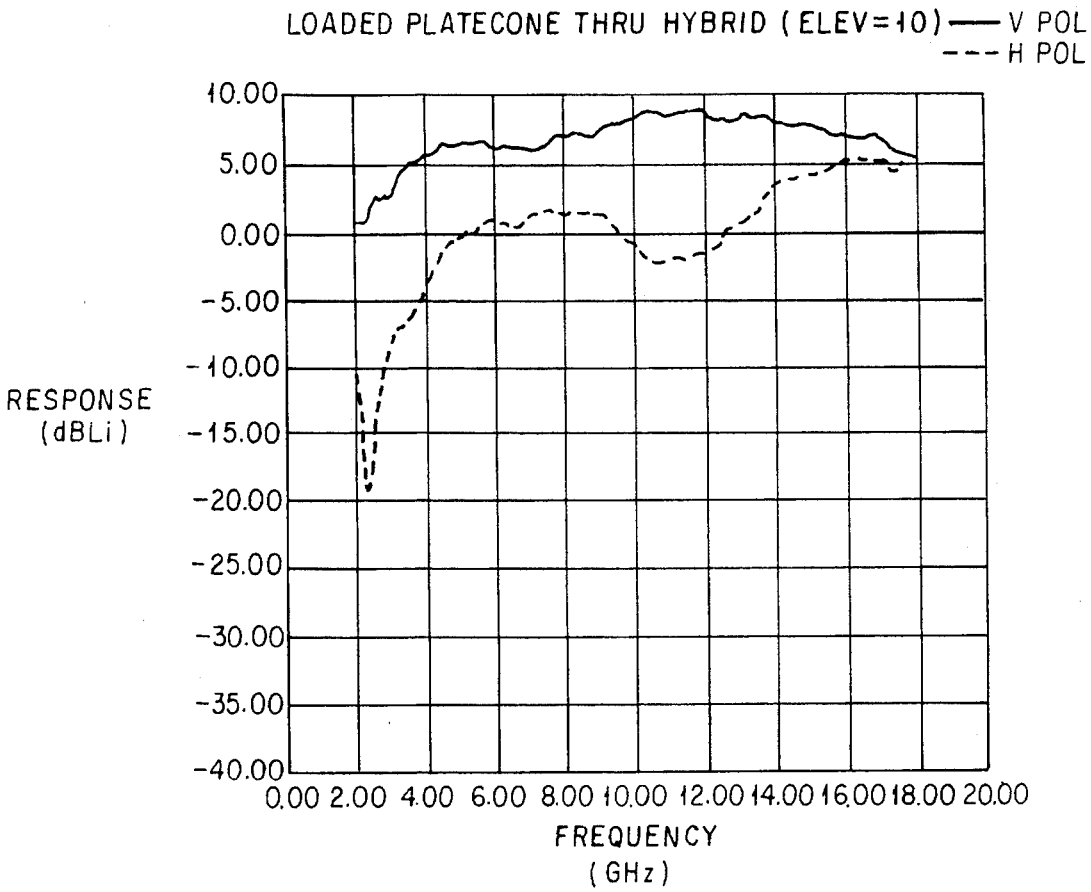
FIG. 8 illustrates the typical segment/flared slot gain performance against a vertically and horizontally polarized source respectively.

Referring to FIG. 8, there is shown the typical segment/flared slot gain performance against a vertically and horizontally polarized source respectively.

Figure 9:
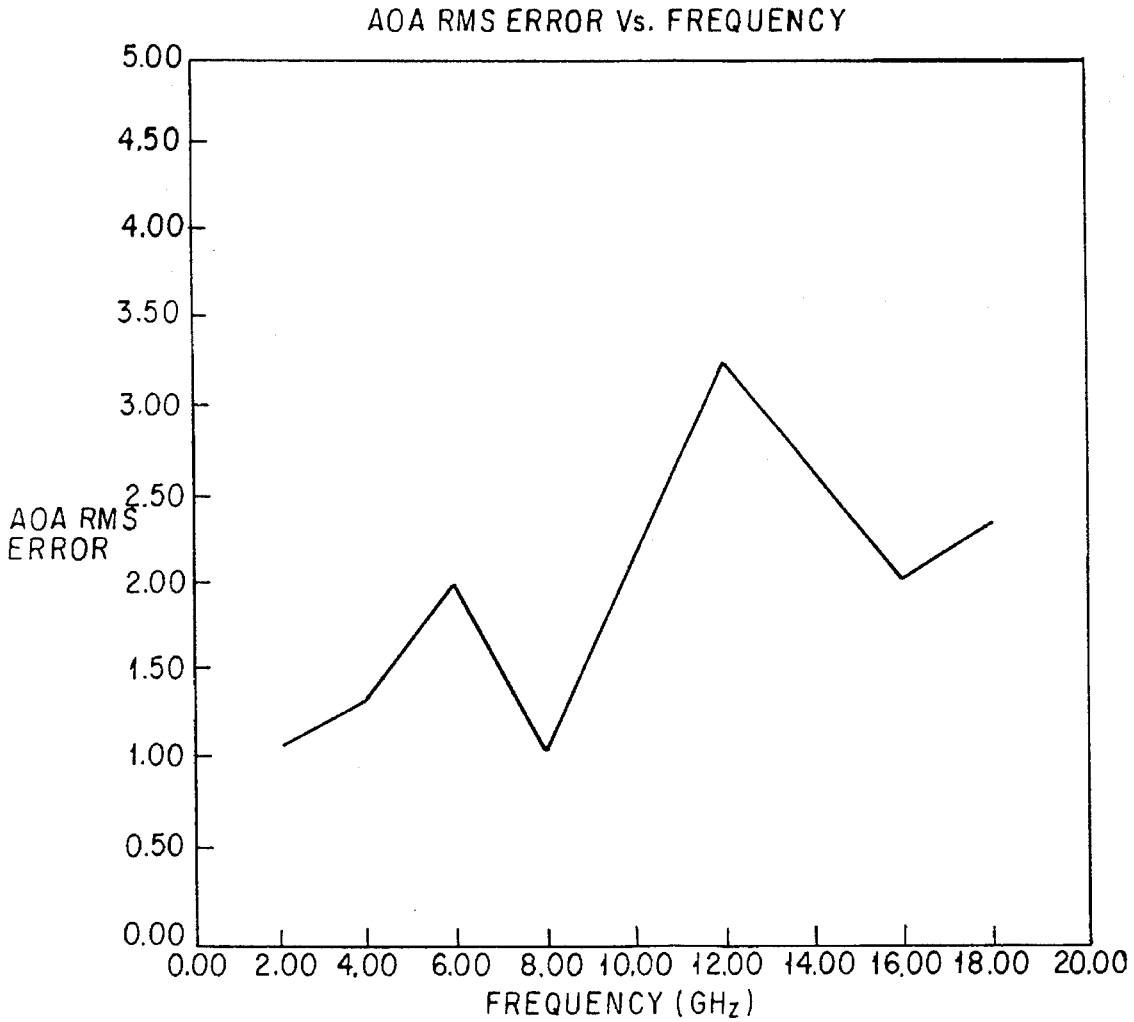
FIG. 9 illustrates the AOA RMS error versus frequency.

Referring to FIG. 9, there is shown the AOARMS error versus frequency.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. An antenna which comprises:

(a) a plurality of spaced apart antenna segments disposed about an axis forming an antenna structure having an apex, said axis passing through said apex;

(b) a solid non-metallic insulating spacer disposed between each of said antenna segments, said insulator having a thickness no greater than 0.2 wavelength at the highest operating frequency of said antenna;

(c) a plurality of rf transmission lines, each of said transmission lines coupled to a different one of said antenna segments for transmitting signals indicative of a predetermined parameter at the associated antenna segment; and (d) a ground plane normal to said axis.

2. An antenna as set forth in claim 1 wherein said antenna segments are substantially pie-shaped.

3. An antenna as set forth in claim 2 wherein said insulator is polytetrafluoroethylene.

4. An antenna as set forth in claim 3 wherein each of said transmission lines is a coaxial cable.

5. An antenna as set forth in claim 2 wherein each of said transmission lines is a coaxial cable.

6. An antenna as set forth in claim 2 wherein each of said antenna segments is flared at the corner regions thereof remote from the apex of said structure.

7. An antenna as set forth in claim 2 wherein said antenna segments are disposed on an electrically insulating sheet.

8. An antenna as set forth in claim 7 wherein each of said antenna segments is flared at the corner regions thereof remote from the apex of said structure.

9. An antenna as set forth in claim 1 wherein said insulator is polytetrafluoroethylene.

10. An antenna as set forth in claim 9 wherein each of said transmission lines is a coaxial cable.

11. An antenna as set forth in claim 1 wherein each of said transmission lines is a coaxial cable.

12. An antenna as set forth in claim 1 wherein said antenna segments are disposed on an electrically insulating sheet.

13. An antenna as set forth in claim 12 wherein each of said antenna segments is flared at the corner regions thereof remote from the apex of said structure.

14. An antenna as set forth in claim 1 wherein each of said antenna segments is flared at the corner regions thereof remote from the apex of said structure.

15. An antenna as set forth in claim 1 wherein the bandwidth of said antenna is up to 36:1.

16. An antenna as set forth in claim 1 wherein said antenna structure is conical.

17. An antenna as set forth in claim 1 wherein said antenna has an instantaneous 360° field of view about the axis of said antenna.

18. An antenna as set forth in claim 1, further including a mode former responsive to signals on said transmission lines to provide direction finding information therefrom.

19. An antenna which comprises:

(a) a plurality of spaced apart antenna segments disposed about an axis forming an antenna structure having an apex;

(b) an insulator disposed between each of said antenna segments;

(c) a plurality of rf transmission lines, each of said transmission lines coupled to a different one of said antenna segments for transmitting signals indicative of a predetermined parameter at the associated antenna segment;

(d) a ground plane normal to said axis; and (e) an electromagnetic absorbent material disposed along the edges of said antenna segments remote from the apex of said structure.

20. An antenna as set forth in claim 19 wherein said antenna segments are disposed on an electrically insulating sheet.

21. An antenna as set forth in claim 20 wherein said electromagnetic absorbent material extends along each of said segments on a portion thereof at the exterior of said segments.

22. An antenna as set forth in claim 19 wherein each of said antenna segments is flared at the corner regions thereof remote from the apex of said structure.

23. An antenna as set forth in claim 22 wherein said electromagnetic absorbent material extends along each of said segments on a portion thereof at the exterior of said segments.

24. An antenna which comprises:

(a) a plurality of spaced apart antenna segments disposed about an axis forming an antenna structure having an apex;

(b) a non-metallic insulating spacer disposed between each of said antenna segments, said insulator having a thickness no greater than 0.2 wavelength at the highest operating frequency of said antenna;

(c) a plurality of rf transmission lines, each of said transmission lines coupled to a different one of said antenna segments for transmitting signals indicative of a predetermined parameter at the associated antenna segment;

(d) a ground plane normal to said axis; and (e) an electromagnetic absorbent material disposed on each of said segments at a portion thereof at the interior of said segments.

25. An antenna as set forth in claim 24, an electromagnetic absorbent material disposed on each of said segments at a portion thereof at the interior of said segments wherein said antenna segments are substantially pie-shaped and wherein said antenna segments are disposed on an electrically insulating sheet.

26. An antenna as set forth in claim 25 wherein said electromagnetic absorbent material extends to an edge of each of said segments remote from the apex of said structure.

27. An antenna which comprises:

(a) a plurality of spaced apart antenna segments disposed about an axis forming an antenna structure having an apex, said antenna segments being substantially pie-shaped;

(b) a non-metallic insulating spacer disposed between each of said antenna segments, said insulator having a thickness no greater than 0.2 wavelength at the highest operating frequency of said antenna;

(c) a plurality of rf transmission lines, each of said transmission lines coupled to a different one of said antenna segments for transmitting signals indicative of a predetermined parameter at the associated antenna segment;

(d) a ground plane normal to said axis; and (e) an electromagnetic absorbent material disposed on each of said segments at a portion thereof at the interior of said segments.

28. An antenna as set forth in claim 27 wherein said electromagnetic absorbent material extends to an edge of each of said segments remote from the apex of said structure.

29. An antenna which comprises:

(a) a plurality of spaced apart antenna segments disposed about an axis forming an antenna structure having an apex;

(b) an insulator disposed between each of said antenna segments;

(c) a plurality of rf transmission lines, each of said transmission lines coupled to a different one of said antenna segments, for transmitting signals indicative of a predetermined parameter at the associated antenna segment; and (d) a ground plane normal to said axis;

(e) the space between each of said segments being a slot, said slot being operational as a slot antenna when said segments on opposing sides of said slot are excited or energized 180 degrees out of phase.

30. An antenna as set forth in claim 29 wherein said antenna segments are substantially pie-shaped.

31. An antenna as set forth in claim 30 wherein said spaced apart antenna segments are disposed on an electrically insulating sheet.

32. An antenna as set forth in claim 29 wherein said spaced apart antenna segments are disposed on an electrically insulating sheet.

33. An antenna which comprises:

(a) a first antenna structure having an axis and comprising:

(i) a plurality of spaced apart first antenna segments disposed about said axis and extending in a first direction along said axis forming a first portion of said antenna;

(ii) a first insulator disposed between each of said first antenna segments;

(b) a second antenna structure coaxial with said axis comprising:

(i) a plurality of spaced apart second antenna segments, electrically isolated from each other, forming a second portion of said antenna and extending in a direction opposite to the first direction;

(ii) a second insulator disposed between each of said second antenna segments; and (c) a plurality of rf transmission lines, each of said transmission lines coupled to a different one of at least one of said first and second antenna segments for transmitting signals indicative of a predetermined parameter at the associated antenna segment.

34. An antenna as set forth in claim 33 wherein said antenna segments are substantially pie-shaped.

35. An antenna as set forth in claim 34 wherein said insulator is polytetrafluoroethylene.

36. An antenna as set forth in claim 35 wherein each of said transmission lines is a coaxial cable.

37. An antenna as set forth in claim 34 wherein each of said transmission lines is a coaxial cable.

38. An antenna as set forth in claim 33 wherein said insulator is polytetrafluoroethylene.

39. An antenna as set forth in claim 38 wherein each of said transmission lines is a coaxial cable.

40. An antenna as set forth in claim 33 wherein each of said transmission lines is a coaxial cable.

41. An antenna as set forth in claim 33 wherein said antenna segments are disposed on an electrically insulating sheet.

* * * * *